United States Patent [19]

White et al.

[11] Patent Number: 4,576,399

[45] Date of Patent: Mar. 18, 1986

[54] BLINDED CODE SHEET FORMAT AND METHOD FOR ITS USE

[75] Inventors: Cathleen A. White, Lawton; Richard K. Senne, Scotts; Harry Rutherford, Kentwood, all of Mich.

[73] Assignee: The Upjohn Company, Kalamazoo, Mich.

[21] Appl. No.: 549,706

[22] Filed: Nov. 7, 1983

[51] Int. Cl.[4] ..... B41L 1/20; B42D 11/00; B42D 15/00; B42D 15/04

[52] U.S. Cl. ..... 282/8 R; 281/18; 282/8 A; 282/8 B; 282/8 C; 282/22 R; 283/70; 283/105; 283/106; 283/901; 283/903

[58] Field of Search ..... 281/18; 282/8 R, 8 A–8 C, 282/1 R, 22 R, 27 R; 283/101, 102, 103, 105, 106, 901, 903, 70

[56] References Cited

U.S. PATENT DOCUMENTS

| | | | |
|---|---|---|---|
| 2,408,626 | 10/1946 | Green | 283/101 |
| 2,812,957 | 11/1957 | Sarlund | 283/103 X |
| 2,828,065 | 3/1958 | Heywood | 229/85 |
| 3,095,088 | 1/1963 | Blaikie et al. | 206/63.2 |
| 3,670,927 | 6/1972 | Hubbard | 222/107 |
| 3,740,081 | 6/1973 | Whipperman | 283/901 X |
| 3,835,988 | 9/1974 | Buttery | 206/45.31 |
| 3,902,655 | 9/1975 | Huffman | 229/69 |
| 3,945,870 | 3/1976 | Johnsen | 283/103 X |
| 3,955,750 | 5/1976 | Huffman | 229/69 |
| 4,010,889 | 3/1977 | Allen et al. | 229/69 |
| 4,033,611 | 7/1977 | Johnsen | 283/106 X |
| 4,241,834 | 12/1980 | Beaucham | 206/611 |

FOREIGN PATENT DOCUMENTS

| | | | |
|---|---|---|---|
| 2023498 | 1/1980 | United Kingdom | 283/102 |

OTHER PUBLICATIONS

Two one-page sketch (by inventors) reproductions (from memory) of a prior format, sample, since destroyed and discarded, used by inventors here in conceiving the claimed format.

*Primary Examiner*—Paul A. Bell
*Assistant Examiner*—Taylor J. Ross
*Attorney, Agent, or Firm*—John T. Reynolds

[57] ABSTRACT

A three panel format and method useful to (a) office, (b) clinical research and (c) statistical personnel in connection with the preparation, identification and statistical evaluation of controlled, blinded code designated samples are provided. The format comprises a write-on panel (A) for mounting code designations, and test substance identities arranged so that the code designations will be transferred through panel (A), and a second, removable panel (B) having rows of writing transference substance thereon to a third panel (C), without transferring the test substance to said panel (C), when panel (A) is folded into an in-line writing relationship with said panels (B) and (C). Thereafter, panels (A) and (C) are folded 360° and sealed in an in-line relationship for use thereafter by clinical and statistical personnel. If necessary, the clinician can learn the identify of a test substance from this format by removing the pertinent, perforated area from panel (C) to see the test substance identity, on panel (A) without jeopardizing the blinded nature of the remaining test substances and patients in the test group. The method comprises (1) folding the format to a writing mode, (2) writing the code designation and identity on the writing areas of panel (A), which become transferred through panel (B) to panel (C), (3) removing the transfer panel (B) and adhesive covering strips, (4) turning panel (A) or (C) in a 360° arc to line up panel (A) behind panel (C) in space relationship, and (5) sealing the folded panel.

5 Claims, 9 Drawing Figures

BLINDED CODE SHEET FORMAT AND METHOD FOR ITS USE

INTRODUCTION

This invention relates to multi-panel office forms. More particularly, this invention provides forms for use by (a) office personnel, (b) doctors, nurses, and other clinical research personnel who do blinded controlled studies of the effects of test substances administered to human or animal patients and then by (c) statisticians, in their respective research contributions. More particularly, this invention provides a method for and a structure of a folded web format device for simplifying the initial preparation of blinded identification documents for clinical investigation of test substances and for enabling clinical research personnel to administer to their patient personnel groups coded lots of test substances such as test drugs and placebo samples (inert innocuous, look-alike medication) by code designations only in a blinded clinical situation, so that neither the clinical investigator nor the patient knows which test substance the patient is receiving, unless and until it may become necessary for the clinical investigator to know what the test substance was. In the event of an undesired adverse reaction in a particular test patient being observed, there might be a need to know the name of the test substance given to the patient so that the patient can be treated to counteract any undesired effect of the test substance. With the new format of this invention, the clinical investigator is able to learn the name of the specifically numbered sample of test substance which was administered to the troubled patient, without destroying or compromising the blinded, clinical evaluation of the other or remaining numbered test substance samples being clinically evaluated in the same test group. Upon the return of this new test sample, blinded format of this invention, the statisticians of the drug company or other organization which requested the blinded clinical trials of the designated samples, can readily determine from a look at the returned format of this invention whether it was necessary for the clinical investigator to break the coded nature of a particular sample designation, by the invasion and removal of the perforated perimeter covering piece of the individual sample to learn the name of the test substance. Then, the statisticians need only remove that broken-code sample designation from their numbers of evaluable patients in the original group who received the various test substances in that group of code designations, in making their statistical evaluations and comparisons of the test substances.

BACKGROUND OF THE INVENTION

Various multi-panel, quick opening or window envelope or carton packages are known. Examples of such include those described in:

(a) U.S. Pat. No. 2,828,065 which describe a quick-opening construction for window envelopes, (b) U.S. Pat. No. 3,835,988 which describes a window carton, for display of bacon or the like, and (c) U.S. Pat. No. 3,955,750 which describes a multi-panel envelope form made of single ply, multi panel forms, having at least one intermediate, removable panel made from a continuous web, for fast construction of advertising or circular-type matter envelopes.

However, to our knowledge, no prior art web format has solved the problem of how to provide a simplified format for use by (a) research office personnel for identification and labeling of randomized samples of test substances (including test drug and placebo formulations) (b) clinical investigator personnel teams who must administer the coded test substances to the human or animal patients, in blinded situations (so that neither the clinical investigator team personnel nor the patient knows what the test substance is), and then observe what they consider to be the medical effects of the test substance, but who, must if necessary, learn the identity of the active test substance, to treat the patient to counteract any severe adverse effects of any particular coded test substance, without jeopardizing the results of the tests in other members of the patient test group; and (c) statisticians who must be confident that the coded, blinded nature of the clinical trials, in doing their statistical analyses of the effects of the various test substances in the test group of patients, has not been compromised by the clinical team's need to know the identity of a particular numbered test sample in that group; and who desire to quickly determine which test sample numbers are to be discarded in their statistical evaluation of the observed effects of the remaining blinded, clinical test observations.

OBJECTS OF THE INVENTION

It is an object of this invention to provide a three panel web format for use by office personnel, clinical investigators and statisticians successively, in doing blinded clinical trials of test substances for evaluating effects of the test substances, which format maintains the blinded nature of their clinical trial but permits the breaking of the code, if necessary, especially in cases of emergency, by the clinician, while maintaining the blinded integrity of the remaining members of the test group of test substances and patients, and which permits ready identification of any test substance designation for which the blind has been broken.

It is a further object of this invention to provide foldable, sealable, three panel structure or format which permits the one-time writing or typing of test substance code designations and chemical or test substance identity names, or other message on one panel (A) the transfer of the identity of the coded test substance designation through the second panel (B) to the third panel (C) which receives only the coded test substance designation, but not the test substance identity or message, and which format can be folded, after removal of the transfer panel (B) to an in-line or registered relationship of panels (C) over panel (A), and sealed to accompany a group of test substance samples for use in this format in conjunction with the test sample administration and observation by clinician test personnel, and then by statistical evaluators.

It is another object of this invention to provide a method for simplifying the arrangement of test sample code and identity writings, while protecting the blinded nature requirement of the test format until breaking of the blinded code in individual patient cases may become necessary, without jeopardizing the blinded, coded identities of the remaining test substances in the test group.

Other objects, aspects and advantages of this invention will be apparent to those skilled in this art.

SUMMARY OF THE INVENTION

Briefly, this invention provides a foldable, sealable, three panel format comprising:

(A) a write or type-on panel for mounting of code designations and test substance identities or message to be hidden in spaced areas thereon bearing lines of protectively covered adhesive on the writing side of said panel (A) between the spaced writing areas thereof, the reverse side of said panel (A) being covered with a security format which blinds the readability of the reverse side writing therethrough, (B) a removable, second panel hingedly spot glued or adhesively connected to said panel (A) at one edge thereof, said second panel (B) having spaced or separated rows of a writing transferance substance, e.g., carbon, or the like, printed or otherwise adhering to the side of the second panel (B) which places the writing transferance substance in a row position to transfer code designation writing therethrough from panel (A) to a third panel (C) without transferring any name of the test substance or hidden message to said third panel (C) when writing is made on (A), when panel (A) is folded into an in-line or registered writing relationship with said panels (B) and (C), and (C) a third panel hingedly or foldably interconnected with said first panel (A) along one edge thereof, said third panel (C) having a number of substantially evenly spaced perforated perimeter areas thereon, said perforated perimeter areas approximating the size, shape and area of the spaced writing areas on said panel (A), and which perforated perimeter areas are spaced on said third panel (C) to line up essentially coextensively, during the writing or typing mode with the spaced writing areas on said first panel (A) when said panels (A), (B) and (C) are folded together, for writing (including typing or printing), said panels (A), (B), and (C) being arranged so that when code designations (or other indicia) and names of test substances or message to be hidden are written on said first panel (A), said code designation will be impressed or transferred through said removable panel (B) to the corresponding perforated blocks of said third panel (C) but so that the test substance name or message to be hidden will not be transferred to said panel (C); and means for folding or hingedly turning panels (A) or (C), after removal of panel (B), and said adhesive protective strips on panels (A), or (C), approximately 360 degrees, relative to each other to an in-line, closed, sealed relationship to each other, so that the spaced, writing areas of panel (A) will be essentially covered by and be in an in-line coextensive relationship with the perforated perimeter areas of panel (C), and means to seal the generally outer edges of said folded, closed, in-line panels (A) and (C) into essentially a folded construction having the spaced write-on areas of panel (A) in line with the covering perforated perimeter areas of panel (C).

Using the above format, this invention also provides a method, usable by research office personnel, clinical investigator personnel and statistician personnel, in succession, for the successive marking/identification; administration/observation under blinded conditions and statistical evaluation of the clinical observation results of blinded test substance drug or other chemical substances.

The method comprises:

(1) folding the panel (A), (B) and (C) format to the writing mode, (by handwriting, typing or printing or the like), (2) writing the code designation and the names of the test substance samples or other message to be hidden in a number of spaced writing areas of panel (A), so that the code designatio will be impressed through the transfer portion of the second panel (B) on to the corresponding perforated perimeter area of panel (C) but the name of the test substance or other message to be hidden will not be so transferred, (3) remove panel (B) from the three panel format, and any protective covering strips from adhesive rows on panel (A) or (C), (4) fold or turn panel (A) or (C) in an essential 360 degree arc or angle along the hingedly connected edges of panels (A) and (C) to line up panel (A) immediately behind panel (C) so that the spaced writing areas of panel (A) are in a registered or in-line, sealed, and covered relationship with the corresponding perforated perimeter areas of panel (C), and (5) sealing the folded panel (A)/ panel (C) format, to ensure integrity of the blinded or hidden message on panel (A) under its corresponding perforated panel (C).

A preferred way to seal together the three non-hinged outer edges of panels (A) and (C) is to have hinged or extended edge extension of either panel (A) or panel (C) with lines of adhesive covered with protected strips until ready for use. When the panel (A)/panel (C) format is to be closed and sealed the protective strips can be removed from such extended edge portions, and the adhesive layered edges can be folded over the outside of the other panel to seal the panel (A)/panel (C) format into a closed, sealed, relationship, like a sealed envelope. Alternatively the outer edges of panels (A) and (C) could be adhesively affixed to each other without the use of extended edges of panel (A) or panel (C).

DRAWING DESCRIPTIONS

FIGS. 1 to 9 provide various views of one specific embodiment or example of the invention.

However, we do not intend that these depicted formats limit the variations of the invention described and claimed herein.

Figure 3:
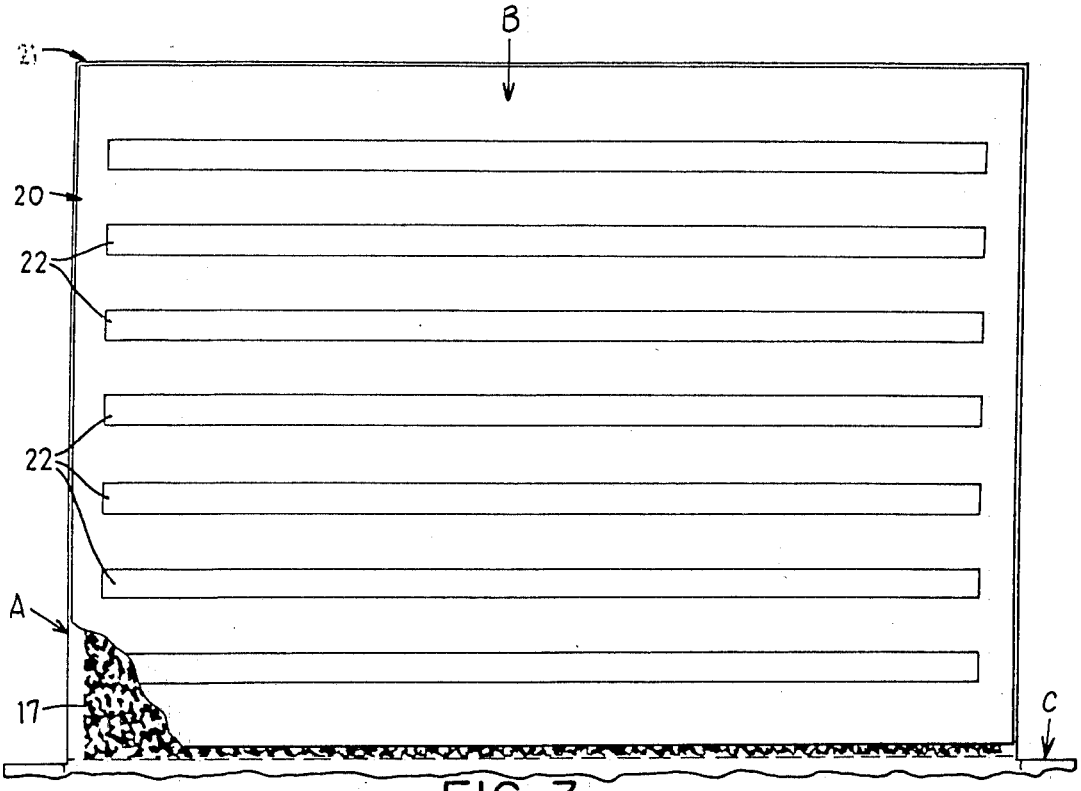

FIG. 3 is a front view of panel (B) showing attachment at top to panel (A), 21, at the top of panel (B) and rows of separated, spaced transfer writing substance, e.g., carbon, for transfer of code designations from panel (A), through panel (B), to panel (C), with spaces having no transfer writing substance on panel (B) to avoid or prevent transfer of test substance names or other message from panel (A) to panel (C). FIG. 3 also shows an area of panel (B) removed so that the backside of panel (A) can be seen covered with a security panel, e.g., a print blinding coating. FIG. 3 also shows on its lower edge foldable or hingedly connected edges of panels (A) (security print area) with panel (C) (wider lower edge).

Figure 4:
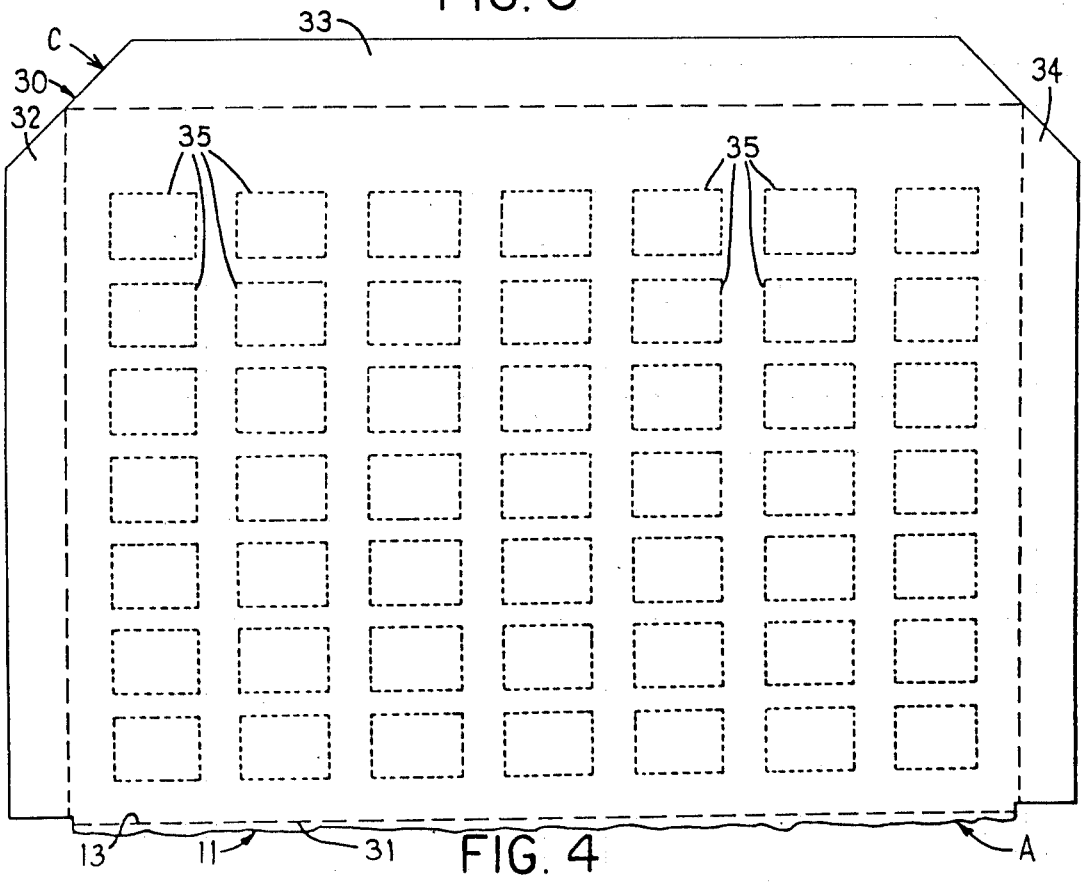

FIG. 4 is a full face view of panel (C) showing fold or hinged connection to panel (A) along its lower edge, and a series of e.g., 49, spaced, perforated perimeter areas to be in registered or in-line relationship with corresponding spaced writing areas of panels (A). FIG. 4 also shows three edges thereof, 32, 33, 34, extended beyond the length and width of panel (A), 11 and which edges are foldable over panel (A) when the format is to be closed after removal of panel (B) from between panels (A) and (C).

Figure 5:
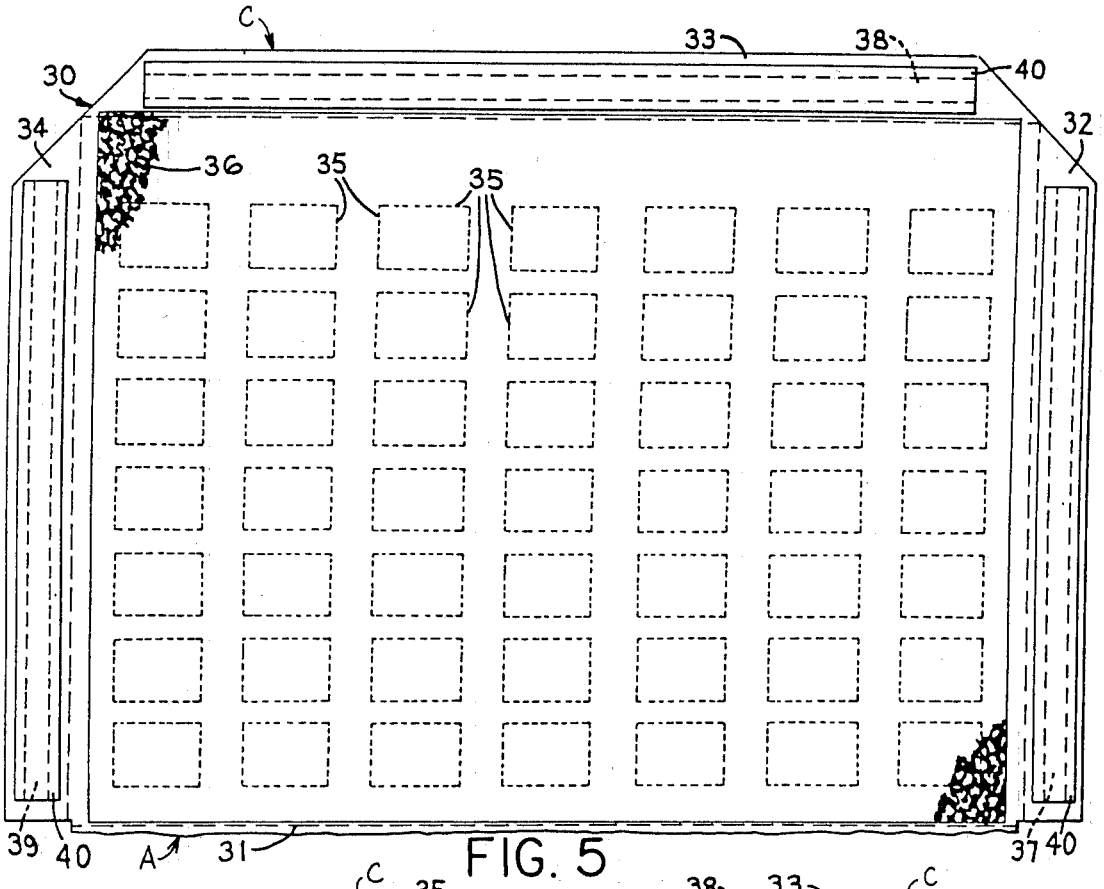

FIG. 5 shows the backside of panel (C) showing blanked or security blinded area (partial) which runs over essentially the whole backside of panel (C) but with unprinted margins if desired, and adhesive rows on the extended edges of panel (C), 30 covered with removable protective strips 16.

Figure 6:
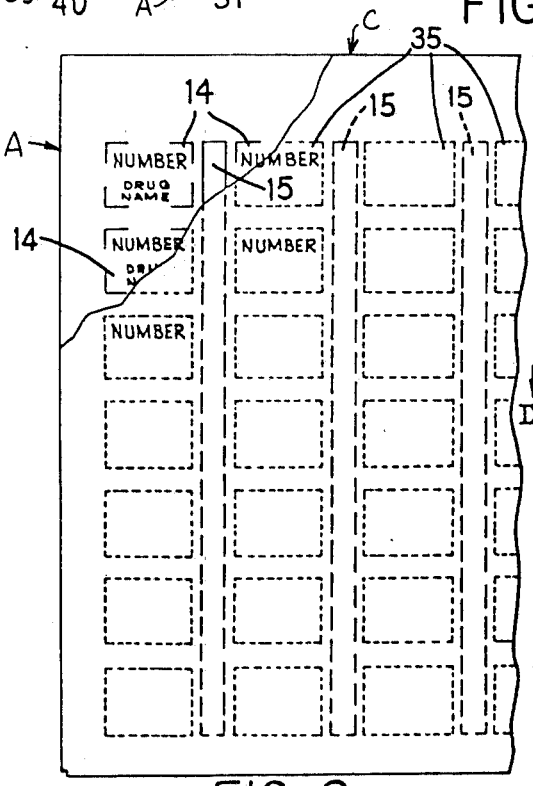

FIG. 6 is a partial view showing panel (C) (partial) closed and sealed over panel (A), after removal of panel (B), showing the code designation "NUMBER" in an in-line line, registered relationship of panel (C) over panel (A), with any test substance identification, e.g., "DRUG NAME", appearing only on the panel (A) writing area.

Figure 7:
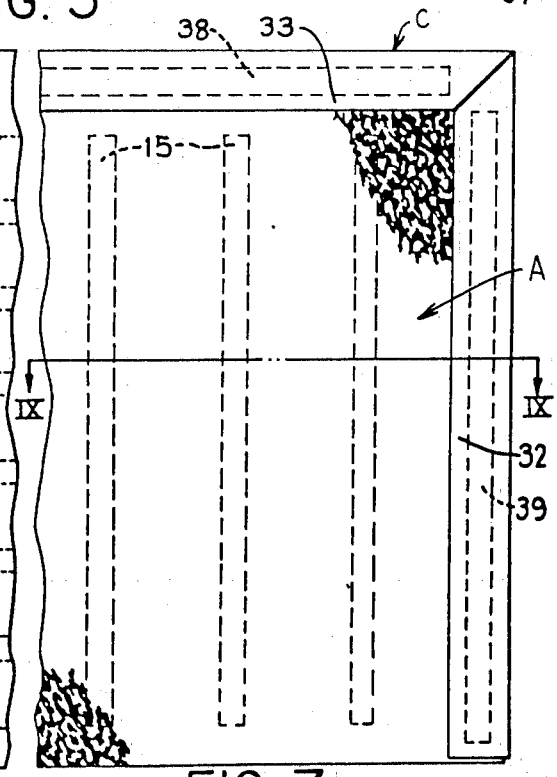

FIG. 7 is a partial back view of FIG. 6 showing the backside security area of panel (C), the lines of adhesive between writing areas of panel (A) and betweenrows of perforated covered areas of panel C, and the edge pieces of panel (C) folded over and sealed to the backside of panel (A).

Figure 8:
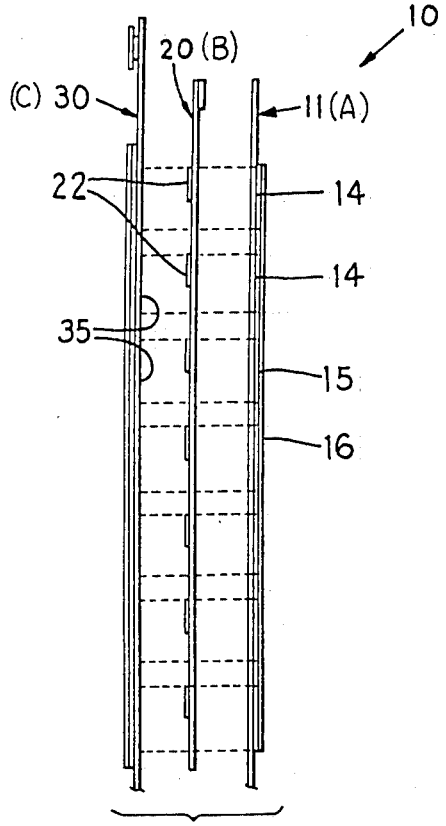

FIG. 8 is an exploded view of the invention from a perpendicular edge view, folded into the writing position.

Figure 9:
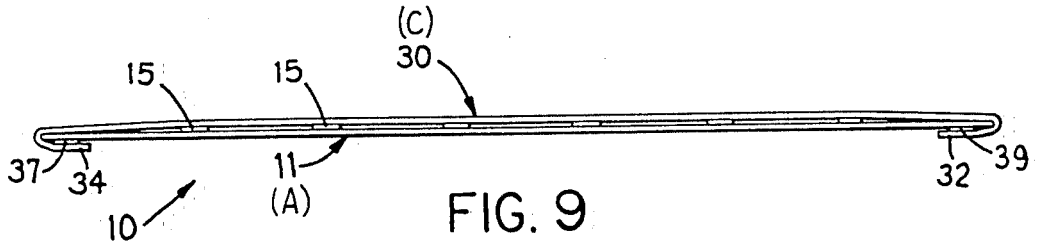

FIG. 9 is a cross sectional view of the invention in sealed, folded position taken along line IX—IX in FIG. 7 showing the uncovered, adhesive sealing strips in place.

Certain terminology will be used in the following description for convenience in reference only, and will not be limiting. For example, the words "in-line", "registered", "upwardly", "downwardly", "rightwardly", and "leftwardly" will refer to directions in the drawings to which reference is made. The words "360" turn of panels (A) or (C) relative to each other is used only as a term of reference to show operation and closure of the format after the code designation and test substance writing has been completed. Said terminology will include the words specifically mentioned, derivatives thereof, and words of similar impact.

DETAILED DESCRIPTION, EXAMPLE AND OPERATION

Figure 1:
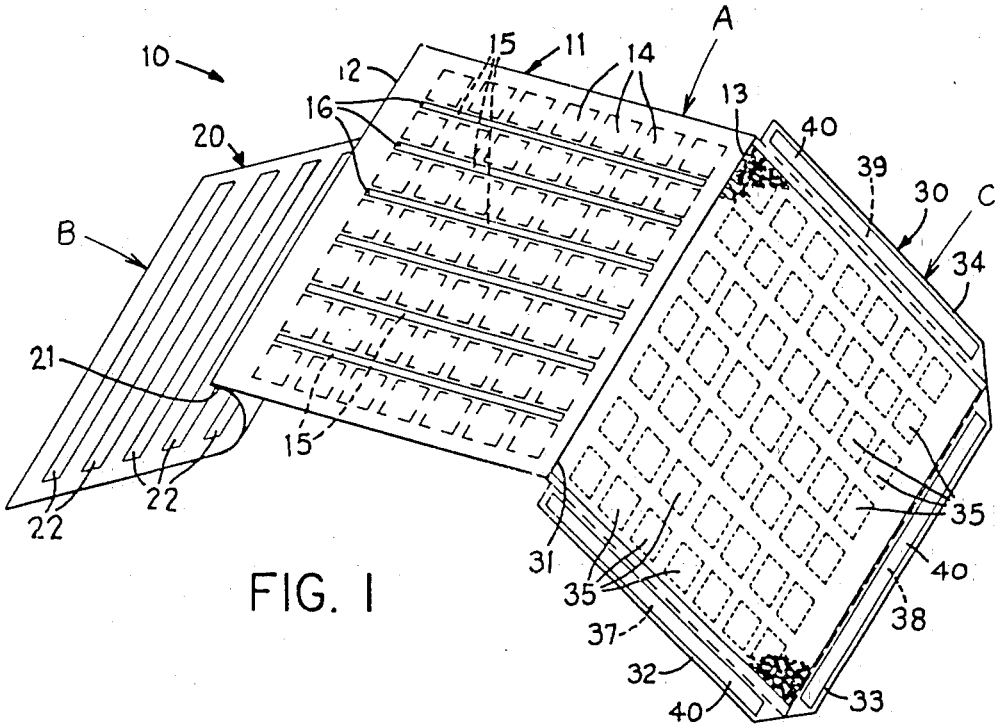
FIG. 1 is a perspective view of the three panel format, showing panels (B), (A) and (C), respectively from left to right in FIG. 1.
Figure 2:
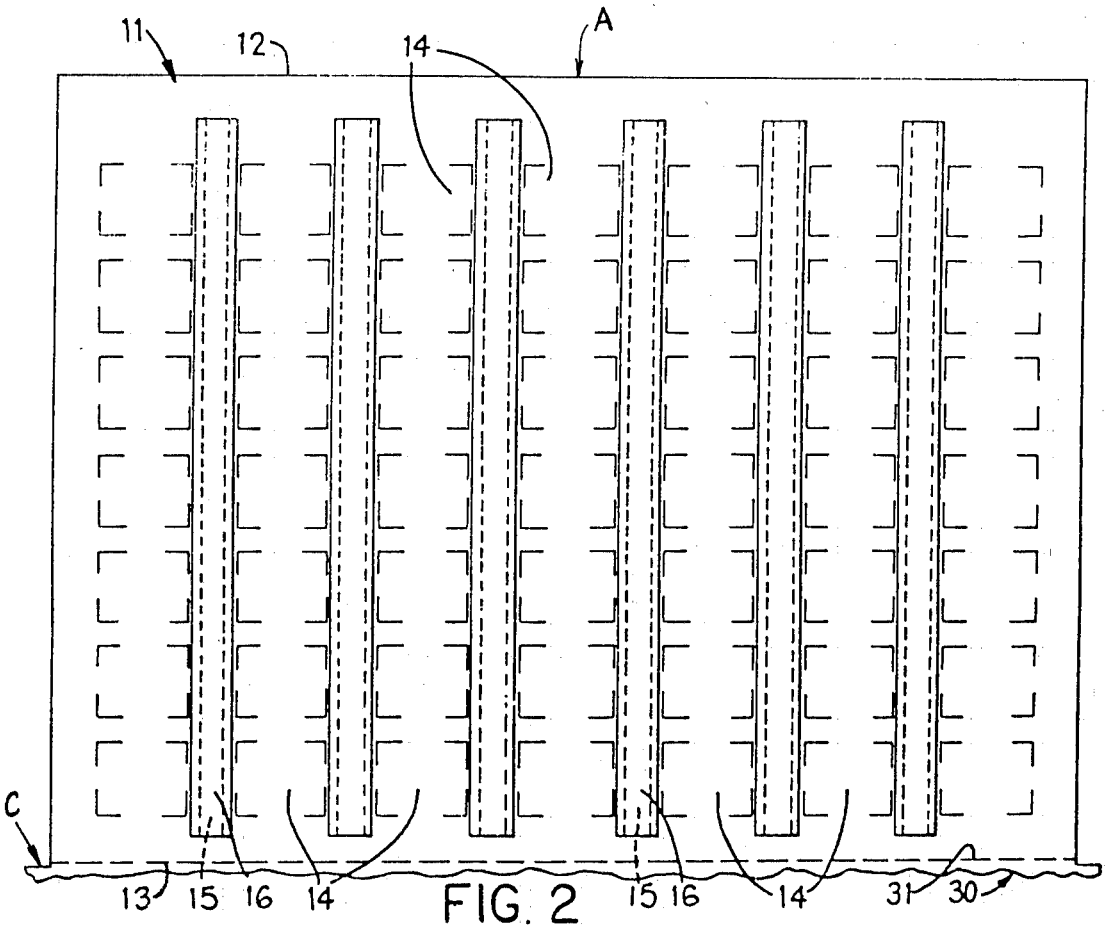
FIG. 2 is a front, full face view of panel A, showing, for example, 49 writing areas for writing code numbers and test substance names therein, and rows of protectively covered adhesive between rows of writing areas, with panel (A) edge area foldably attached to panel (C).

The three panel format of the invention is shown, before writing, in FIG. 1, referred to as 10, in rectangular shape or form. Other shapes such as circles, ovals and irregular shapes of the three panel format or writing areas, e.g., as for organization origin, trademark purposes can be used. In FIGS. 1 and 2, the writing side of panel (A) is shown generally at 11, showing attachment of panel (A) to panel (B) 20 at edge 12, and panel (A) hingedly connected to panel (C) 30 at edge 13. The spaced areas on panel (A) for writing, e.g., by longhand, typing, printing, etc. are shown by numbered areas 14. Protectively covered adhesive strips 15 are shown between rows of writing areas 14. The removable adhesive cover strips are shown at 16.

Panel (B) 20 show in FIGS. 1 and 3 is adhesively or otherwise removably connected to panel (A) at edge 21. FIGS. 1 and 3 show the rows of separated, spaced, transfer writing substance, e.g., a carbon writing composition at 22. The spaces between the rows of transfer writing substance are large enough to not transfer the names of test substance or other message which is written on the writing area 14 of panel (A) but which is not intended to be carried through panel (B) to panel (C), perforated areas 35.

The backside of panel (C) 30 shown in FIG. 1 is foldably or otherwise hingedly connected to the front side of panel (A) edge 13 (FIG. 1) and at 31, (FIG. 4). The front side of panel (C), FIG. 4, shows edges 32, 33, and 34 of panel (C) extending beyond the length and width connecting edge of panel (A). Alternately, the extended edges could be on panel (A) for folding over panel (C). The spaced, perforated, perimeter areas 35 of panel (C), shown in FIG. 4, for exemplification in rectangular shape, are so placed on panel (C) to be in registered in-line relatinship behind and with corresponding line-up with the spaced writing areas 14 of panel (A), in the writing mode of the format.

The backside of panel (C), 30 FIG. 5, is shown (partially) bearing an optional security or writing blinding surface 36. The extended panel (C) edges are shown at 32, 33, and 34 are shown to bear adhesive protective covering strips 38, 39 and 40.

After the writing of transferable code numbers and non-transferred test substance names or other message on panel (A) in the writing mode, the operator removes panel (B) 20 from the format 10 and folds panel (A) or (C), essentially to a full circle 360° C. turn so that the panel (C) front side is now in front of panel (A), removes the adhesive protective strips 16, 38, 39 and 40 and presses panels (C) and (A) together so as to line up the written areas 14 of panel (A) with the perforated areas 35 of panel (C) and then seals the edges of panel (A) within the extended edges of panel (C), e.g., by folding over adhesive containing panel (C) edges 32, 33 and 34 in a pressing, adhering manner over panel (A), FIGS. 5, 6 and 7, as well as sealing the areas between the writing areas 14 of panel (A) and perforated areas of panel (C), to prevent peeking by clinical investigators at the identification test substance name number an adjacent code number area.

The three panel format 10 from the side or edge view, in the writing, e.g., typing or printing position, is illustrated in FIG. 8. Panel (A) 11 on the right, including the several spaced writing areas 14, with the rows of protectively covered adhesive areas 15, and the adhesive covering strips 16 is shown in vertical, lined-up relationship with panel (B) 20 showing spaced rows of separated transfer writing substance, e.g., carbon (7 shown) 22, and with panel (C) 30 showing several spaced, perforated perimeter areas 35 in lined-up or registered relationship with transfer writing substance areas 22 of panel (B) and the areas with no transfer writing substance. Thus, when the writer (Research or office personnel) writes or types or prints the code number and test substance name or other message on panel (A) in writing area 14, the code number is pressed from writing area 14 through the panel (B) transfer writing substance 22 to the corresponding panel (C) writing receiving perforated area 35, but the writing or typing of the test subsance name or other message below the code number or designation and below transfer area 22 on the panel (A) writing area 14, is not carried through the panel (B) 20 to the corresponding panel (C) perforated writing area.

The closed, sealed panel (A)/panel (C) format, after removal of panel (B), for use by clinical research followed by statistician personnel, is illustrated in cross section in FIG. 9 which shows the format 10 having panel (A) 11 as the lower panel having thereon the rows of adhesive 15 (with the protective cover strips 16 removed), so that panel (A) as adhesively bonded to the upper panel (C) 30, and as folded or hingedly connected to panel (A) at common edge 31. The extended edges 32 and 34 of panel (C) are shown turned over and around the edges of panel (A) and being adhesively connected thereto by adhesive rows 37 and 39 (after removal of the protective covering strips 40).

This format 10, so closed and constructed, is intended for use with and intended to accompany a number of coded number labeled bottles or other packages from a research or study organization to a clinical research team organization for use in identify code numbers with patients and test substances (active test drug compositions in any appropriate pharmaceutical form, or with a look-alike placebo, or alternate, comparative test drug substance, without letting the clinical team know which test substance they are administering and observing in the patients in their test patient population groups.

For this purpose, the finished panel (A)/panel (C) format herein will probably have printed on the top, front portion of panel (C), instructions to the clinical research team such as "This blinding scheme must be returned to . . . A written justification . . . for each tab [Panel (C) perforated area 35] removed.

Such panel (C) can also have printed, typed or otherwise written thereon the name of the test substance submitting organization, its address, the test substance name, a study purpose statement, the name of the Clinical Investigator supervising the administration of the blinded test substances and the observed effects, any clinical trial number, and the like.

Thus, after administration of any blinded test substance to a patient if the clinician team observes any undesired, untoward or unexpected effects in the patient, and the clinician feels he needs to known the identification of the coded test subsance, he can obtain that information by removing the appropriate matching coded perforated area 35 to learn the name of the test substance, without jeopardizing the blind for the test for other members of his or her clinical test patient population. Also, when that is done, and the format is returned to the submitting organization or the appropriate statistical evaluators, the statistical evaluator personnel can tell at a glance which patients must be removed from the test group for their statistical evaluation calculations.

This panel (A)/panel (C) format is intended to be used with (1) lists of numbers and patients, and (2) reports of observed effects of the various blinded test substances in various patients, identified only by numbers.

The format of this invention obviates problems of maintaining reasonable certainty of blinded clinical test conditions being used by clinical team members handling groups of test patients under a variety of office, patient confidentiality, and patient reaction conditions, to the reasonable satisfaction of statistical evaluators and governmental authorities, without extensive time consuming labor by Research and office personnel.

It is also to be understood that the attachment or sealing of the panels to one another for the purposes and functions described above could be accomplished by equivalent means other than by the use of adhesives. For example, one could use staples, brads, or the like to mechanically bind the panels together to accomplish essentially the same format purposes. However, in our view such methods would be labor intensive and would not provide the best mode of construction of these formats.

The blinded, code sheet structure of this invention offers several advantages over currently used methods involving tear-off labels on the clinical test medication bottles. With this invention, the blinded code sheet format can be kept at a central location such that an emergency "phone-in" system for breaking the blinded code can be employed, if necessary. For example, a large hospital could provide a 24-hour emergency phone number to out-patients involved in clinical trials, and their doctors, when medication codes must be broken in the event of an adverse reaction or other untoward physical event. A number of these herein described blinded, code sheet formats can be stored together in a standard size file or in an $8\times10$, or other appropriate dimension ring notebook. This blinded, code sheet format allows for the breaking of a single code number while protecting the integrity of those remaining. The blinded, code sheet format of this invention is not as easily lost or misplaced as are the tear-off labels on some clinical trial bottle systems. This new code sheet format allows the clinical trial monitoring company to determine at a glance which code numbers have been tampered with. The essential purpose of this blinded sheet format is to provide an efficient emergency method for revealing medication codes and further to provide the clinical research sponsoring organization information, at a glance, regarding which, if any, patients' codes were broken, and thus are no longer evaluable as part of the clinical trial.

Instructions to clinical investigators using this new blinded code format require notification by the clinical staff to the sponsor within 24 hours should a code be broken, immediate withdrawal of the number coded patient from the clinical study once the medication code is revealed, and the date and time that the medication code was broken must be recorded on this blinded code format, and then this blinded code format must be returned to the sponsoring organization at the completion of the clinical study.

We claim:

1. A three-paneled code sheet construction form useful to control blinded clinical trials of drugs and chemicals, which comprises (A) a first panel for test messages of generally single ply configuration having a number of substantially spaced writing areas on one writing mode side thereof, with room in the spaced writing areas sufficient for writing code designations and an appropriate test message said panel (A) having one or more lines of adhesive bonded to said writing mode side of said first panel (A), said adhesive being covered by removable strips of an adhesive protective liner to prevent the adhesive from sticking until ready for closing of said code sheet construction form, the other side of said first panel (A) being covered with a security format;

(B) a removable, second panel of generally single ply construction removably connected to said panel (A) at one edge thereof, and said panel (B) having spaces of writing transference substance printed or otherwise adhering to the side of said second panel which places the writing transference substance in a position to transfer said code designation writing therethrough from panel (A) to a third panel (C), without transferring any said message to said third panel (C) in a writing mode when writing is made on panel (A); and (C) said third panel of generally single ply configuration hingedly interconnected with said first panel (A) along a second edge thereof;

said third panel (C) having a number of spaced perforated perimeter areas thereon, said perforated perimeter areas approximating the size, shape, and area of the spaced writing areas on said panel (A), and which perforated perimeter areas are spaced on said third panel (C) to line up essentially coextensively in essential registered relationship with the spaced writing areas on said first panel (A), when said panels (A), (B) and (C) are folded together for said writing mode;

said panels (A), (B) and (C) being arranged so that when said code designations and tests messages are written on said first panel (A) said code designation writings will be impressed through said first panel (A) and said second panel (B) to the corresponding perforated perimeter areas of said third panel (C) but the test message will not be transferred to said panel (C), and means to fold panels (A) and (C) approximately 360 degrees after the writing mode is completed to an in-line, closed, sealed relationship to each other, so that the spaced writing areas of panel (A) will be essentially covered and be in an essentially in-line relationship with the the perforated perimeter areas of panel (C), and means to seal the outer edges of said folded, closed, in-line panels (A) and (C) into essentially a folded construction, having the written-on writing areas of panel (A) in-line with and being covered by perforated perimeter areas of panel (C).

2. A three paneled code sheet construction sheet form according to claim 1 having attached to said panel (C) foldable edge portions on the three sides of said panel (C) which are not hingedly attached to said panel (A);

said foldable edge portions serving to seal panels (A) and (C) together, into the folded construction.

3. A method for arranging test sample code and sample identity designations using a multi-panel format which comprises (1) folding the three panel format of claim 1 to the writing mode, (2) writing the code designations and the message to be hidden in a number of said spaced writing areas of panel (A), so that the code designation will be impressed through the transfer substance spaces of the second panel (B) to the corresponding perforated perimeter area of the third panel (C), but so that the message to be hidden will not be transferred from panel (A), (3) removing the transfer panel (B) from the above three panel format and any protective liner strips from any adhesive lines on panel (A), (4) fold or turn panel (A) or (C) in an essential 360 degree arc along the hingedly connected edge of panel (A) and (C) to line up panels (A) immediately behind panel (C) so that the spaced writing areas of panel (A) are in registered relationship with the corresponding perforated perimeter areas of panel (C), and (5) sealing the resulting folded panel (A)/panel (C) format to ensure integrity of the blinded hidden messages on panel (A) under the corresponding perforated areas of panel (C).

4. A method according to claim 3 wherein the outer edges of the panel (A)/panel (C) format are sealed by hingedly connected, extended edges of the panels (A) or (C) with lines of adhesive on said edges which function to seal the panel (A)/panel (C) format into a closed position when the adhesive bearing edges of the one panel are turned over and pressed onto the other panel.

5. A multi-panel code sheet useful to control blinded clinical trials of drugs and chemicals, comprising:

a first panel having a plurality of spaced writing areas on one side thereof, each writing area comprising a first portion for a test message and a second portion for a code designation, said first panel having multiple lines of adhesive extending between said writing areas on said one side and said adhesive lines being covered by removable strips of an adhesive protective liner, the other side of said first panel being covered with a security format;

a second panel removably connected to said first panel at one edge thereof, said second panel having spaced areas of a writing transferance substance on one side thereof, said substance being arranged so as to underlie only the second portion of each spaced writing area when said first and second panels are folded together;

a third panel hingedly connected to said first panel along another edge thereof, said third panel having a plurality of spaced perforated perimeter areas thereon, said perimeter areas approximating the size, shape and area of said spaced writing areas, said perimeter areas being arranged so as to line up substantially co-extensively and in registered relationship with said spaced writing areas when said first and third panels are folded together;

said second panel being foldable about said one edge of said first panel so that three panels may be folded into a first configuration with said one said of said first panel uppermost and said one side of said second panel in facing relationship with one side of said third panel, such that when writing in the spaced writing areas only the writing in the second portions is transferred to said perimeter areas on said one side of said third panel;

said third panel being foldable about said other edge of said first panel to a second configuration with said one side of said third panel uppermost and said one side of said first panel in facing relationship with said third panel; and means to seal the edges of said first and third panels in said second configuration.

* * * * *